US006888309B2

(12) United States Patent
Park et al.

(10) Patent No.: US 6,888,309 B2
(45) Date of Patent: May 3, 2005

(54) PLASMA DISPLAY PANEL

(75) Inventors: Hun Gun Park, Kumi-shi (KR); Jae Hwa Ryu, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 212 days.

(21) Appl. No.: 10/196,125

(22) Filed: Jul. 17, 2002

(65) Prior Publication Data

US 2003/0015964 A1 Jan. 23, 2003

(30) Foreign Application Priority Data

Jul. 18, 2001 (KR) ..... P2001-43080

(51) Int. Cl.[7] ..... H01J 17/49
(52) U.S. Cl. ..... 313/585; 313/584

(58) Field of Search ..... 313/582–587, 313/495–497

*Primary Examiner*—Ashok Patel
(74) *Attorney, Agent, or Firm*—Fleshner & Kim, LLP

(57) ABSTRACT

A plasma display panel wherein sustain discharge spaces can be arranged at an equal distance. In the plasma display panel, each of a plurality of first electrode groups includes first and second electrodes formed adjacently to each other and third electrodes spaced at a large distance from the second electrodes. A plurality of second electrode groups are adjacent to the first electrode groups and have the first electrodes, the second electrodes and the third electrodes arranged in a mirror type. One sides of the first electrode groups and the second electrode groups are set to a first distance including widths of the third electrodes being adjacent to each other. Other sides of the first electrode groups and the second electrode groups are set to a second distance equal to the first distance including widths of the second electrodes.

15 Claims, 9 Drawing Sheets

PLASMA DISPLAY PANEL

BACKGROUND OF THE INVENTION

1. Field of the Invention

This invention relates to a plasma display panel, and more particularly to a plasma display panel wherein sustain discharge spaces can be arranged at an equal distance.

2. Description of the Related Art

Generally, a plasma display panel (PDP) is a display device utilizing a visible light emitted from a fluorescent body when an ultraviolet ray generated by a gas discharge excites the fluorescent body. The PDP has an advantage in that it has a thinner thickness and a lighter weight in comparison to the existent cathode ray tube (CRT) and is capable of realizing a high resolution and a large-scale screen. The PDP includes of a plurality of discharge cells arranged in a matrix pattern, each of which makes one pixel of a field.

FIG. 1 is a perspective view showing a discharge cell structure of a conventional three-electrode, alternating current (AC) surface-discharge PDP.

Referring to FIG. 1, a discharge cell 1 of the conventional three-electrode, AC surface-discharge PDP includes a first electrode 12Y and a second electrode 12Z provided on an upper substrate 10, and an address electrode 20X provided on a lower substrate 18. Such a discharge cell 1 is arranged at a panel in a matrix type as shown in FIG. 2.

On the upper substrate 10 provided with the first electrode 12Y and the second electrode 12Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with fluorescent layers 26. The address electrode 20X is formed in a direction crossing the first electrode 12Y and the second electrode 12Z. The barrier rib 24 is formed in parallel to the address electrode 20X to prevent an ultraviolet ray and a visible light generated by a discharge from being leaked to the adjacent discharge cells.

The fluorescent layers 26 is excited by an ultraviolet ray generated during the plasma discharge to generate any one of red, green and blue visible light rays. An inactive gas for a gas discharge is injected into a discharge space defined between the upper and lower substrate 10 and 18 and the barrier rib 24. A black matrix 30 is formed between the first electrode 12Y and the second electrode 12Z which are provided at the adjacent discharge cells 1.

Such an AC surface-discharge PDP drives one frame, which is divided into various sub-fields having a different discharge frequency, so as to express gray levels of a picture. Each sub-field is again divided into an initialization period for uniformly causing a discharge, an address period for selecting the discharge cell and a sustain period for realizing the gray levels depending on the discharge frequency. For instance, when it is intended to display a picture of 256 gray levels, a frame interval equal to 1/60 second (i.e. 16.67 msec) is divided into 8 sub-fields. Each of the 8 sub-fields is divided into an address period and a sustain period. Herein, the reset period and the address period of each sub-field are equal every sub-field, whereas the sustain period are increased at a ration of $2^n$ (wherein n=0, 1, 2, 3, 4, 5, 6 and 7) at each sub-field. Since each sub-field has a different sustain period, it is able to express a gray scale of a picture.

In the reset period, a reset pulse is applied to the first electrode 12Y to cause a reset discharge. In the address period, a scanning pulse is applied to the first electrode 12Y and a data pulse is applied to the address electrode 20X, to thereby cause an address discharge between two electrodes 12Y and 20X. Upon address discharge, wall charges are formed at upper and lower dielectric layers 14 and 22. In the sustain period, an alternating current applied alternately to the first electrode 12Y and the second electrode 12Z generates a sustain discharge between the first electrode 12Y and the second electrode 12Z.

However, such an AC surface-discharge PDP has a sustain discharge that concentrates on the center of the upper substrate 10, to thereby deteriorate the utility of a discharge space. Accordingly, it has a problem in that a discharge area is reduced to deteriorate a light-emission efficiency. In order to solve such a problem, a four-electrode PDP as shown in FIG. 3 has been suggested.

FIG. 3 and FIG. 4 show a conventional four-electrode AC surface-discharge PDP.

Referring to FIG. 3 and FIG. 4, a discharge cell 50 of the conventional four-electrode AC surface-discharge PDP includes a first electrode T, a second electrode Y and a third electrode Z provided on an upper substrate 32, and an address electrode A provided on a lower substrate 38. Such a discharge cell 50 is arranged in a matrix type as shown in FIG. 4.

The first electrode T and the second electrode Y have a narrow gap while the third electrode Z has a wide gap from the second electrode Y. On the upper substrate 32 provided with the first to third electrodes T, Y and Z in parallel, an upper dielectric layer 34 and a protective film 36 are disposed. Wall charges generated upon plasma discharge are accumulated into the upper dielectric layer 34. The protective film 36 prevents a damage of the upper dielectric layer 64 caused by a sputtering during the plasma discharge and improves the emission efficiency of secondary electrons. The protective film 36 is usually made from a magnesium oxide (MgO).

A lower dielectric layer 42 and barrier ribs 44 are formed on the lower substrate 38 provided with the address electrode A. The surfaces of the lower dielectric layer 42 and the barrier ribs 44 are coated with fluorescent layers 46. The address electrode A is formed in a direction crossing the first electrode to third electrodes T, Y and Z. The barrier rib 44 is formed in parallel to the address electrode A to prevent an ultraviolet ray and a visible light generated by a discharge from being leaked to the adjacent discharge cells.

The fluorescent layer 46 is excited by an ultraviolet ray generated during the plasma discharge to generate any one of red, green and blue visible light rays. An inactive gas for a gas discharge is injected into a discharge space defined between the upper and lower substrate 32 and 38 and the barrier rib 44. A black matrix 40 is formed between the third electrode Z and the first electrode T which are provided at the adjacent discharge cells.

In the reset period, a reset pulse is applied to any one of the first to third electrodes T, Y and Z to cause a reset discharge within the discharge cell 50. In the address period, a scanning pulse is applied to the first or second electrode T or Y and a data pulse is applied to the address electrode A, to thereby cause an address discharge between the first or second electrode T or Y and the address electrode A. Upon address discharge, wall charges are formed at upper and lower dielectric layers 34 and 42. In the sustain period, a sustain pulse is alternately applied to the second electrode Y and the third electrode Z to thereby generate a sustain discharge at the two electrodes Y and Z.

In such a conventional four-electrode AC surface-discharge PDP, a utility of the discharge space is improved because the second electrode Y and the third electrode Z causing a sustain discharge is set to have a wide gap from each other. Accordingly, a discharge area is enlarged to enhance a light-emission efficiency.

However, the conventional four-electrode AC surface-discharge PDP is supplied with a sustain pulse having a high voltage level than the three-electrode AC surface-discharge PDP because it causes a sustain discharge between the second electrode Y and the third electrode Z that are set at a wide gap. Accordingly, an erroneous discharge may be generated between the third electrode Z and the first electrode T being adjacent to each other with having the black matrix 40 therebetween. In other words, since different electrodes are provided with being intervened with the black matrix 40 to thereby generate a desired voltage difference, an erroneous discharge may occur between the adjacent discharge cells.

In order to overcome such an erroneous discharge phenomenon, there has been suggested a four-electrode AC surface-discharge PDP as shown in FIG. 5.

FIG. 5 shows a four-electrode PDP according to another conventional embodiment.

Referring to FIG. 5, the PDP according to another conventional embodiment has the same electrodes that are adjacent to each other with having black matrices 58 and 60 therebetween. In other words, first and second discharge cells 52 and 54 being adjacent to each other at the upper and lower portion are adjacent to an identical electrode Z with having the first black matrix 58 therebetween. Further, second and third discharge cells 54 and 56 being adjacent to each other at the upper and lower portion are adjacent to an identical electrode T with having the second black matrix 60 therebetween. In other words, the electrodes T, Y and Z shown in FIG. 5 are arranged in a mirror type around the black matrices 58 and 60.

If the same electrodes Z, Z or T, or T are provided with having the black matrices 58 and 60 therebetween, then an erroneous discharge is not generated between the adjacent discharge cells 52, 54 and 56. In other words, the adjacent electrodes Z, Z or T, or T are supplied with pulses having the same polarity, so that an erroneous discharge between the adjacent discharge cells 52, 54 and 56 can be prevented.

In such a conventional four-electrode AC surface-discharge PDP, the first electrode T and the second electrode Y have a narrow distance D1 from each other while the second electrode Y and the third electrode Z have a wide distance D2 have a wide distance D2. In the four-electrode AC surface-discharge PDP, a discharge space D2 between the second electrode Y and the third electrode Z contributes to a real brightness. The discharge space D2 positioned within each discharge cell 52, 54 and 56 must be arranged at an equal distance. In other words, all the discharge spaces D2 are arranged at an equal distance such that the PDP has a uniform brightness. However, in the four-electrode PDP as shown in FIG. 5, the discharge cells fails to be arranged at an equal distance.

More specifically, the discharge space D2 of the first discharge cell 52 and the discharge space D2 of the second discharge cell 54 are spaced at a first distance D3 from each other. Otherwise, the discharge space D2 of the second discharge cell 54 and the discharge space D2 of the third discharge cell 56 are spaced at a second distance (i.e., D1+D3+D1) larger than the first distance D3 from each other. In other words, the discharge cells 52, 54 and 56 fails to be set at an equal distance.

If the discharge cells fails to be arranged at an equal distance as mentioned above, then a brightness at the first distance D3 is set to be different from a brightness at the second distance D1+D3+D1 as shown in FIG. 6. In other words, since the second distance D1+D3+D1 is set widely, a light generated at the second distance D1+D3+D1 has a lower brightness than a light generated at the first distance D1. As a result, the PDP shown in FIG. 5 fails to display a uniform picture and generates a stripe at its horizontal line.

SUMMARY OF THE INVENTION

Accordingly, it is an object of the present invention to provide a plasma display panel wherein sustain discharge spaces are arranged at an equal distance.

In order to achieve these and other objects of the invention, a plasma display panel according to one embodiment of the present invention includes a plurality of first electrode groups, each of which includes first and second electrodes formed adjacently to each other and third electrodes spaced at a large distance from the second electrodes; and a plurality of second electrode groups being adjacent to the first electrode groups and having the first electrodes, the second electrodes and the third electrodes arranged in a mirror type, wherein one sides of the first electrode groups and the second electrode groups are set to a first distance including widths of the third electrodes being adjacent to each other, and other sides of the first electrode groups and the second electrode groups are set to a second distance equal to the first distance including widths of the second electrodes.

In the plasma display panel, the second distance includes a width of the second electrode of the first electrode group and a width of the first electrode thereof, and a width of the first electrode of the second electrode group and a width of the second electrode thereof.

A sustain discharge contributing to a brightness occurs at a discharge space between the second electrode and the third electrode.

Discharge spaces included in the first and second electrode group are arranged at an equal distance.

The plasma display panel further includes a first black matrix provided between said three electrodes; and a second black matrix formed at the same width as the first black matrix in such a manner to overlap with the first electrodes.

Otherwise, the plasma display panel further includes a first black matrix provided between said three electrodes; and a second black matrix formed at the same width as the first black matrix between first electrodes.

The first to third electrodes are set to have the same width.

At least one of the first to third electrodes is set to have a different width.

A plasma display panel according to another embodiment of the present invention includes a plurality of first electrode groups, each of which includes first and second electrodes formed adjacently to each other and third electrodes spaced at a large distance from the second electrodes; and a plurality of second electrode groups being adjacent to the first electrode groups and having the first electrodes, the second electrodes and the third electrodes arranged in a mirror type, wherein a sustain discharge contributing a brightness is generated at a discharge space between the second electrode and the third electrode, and said discharge spaces included in the first electrode group and the second electrode group are arranged at an equal distance.

In the plasma display panel, one sides of the first electrode groups and the second electrode groups are set to a first distance including widths of the third electrodes being adjacent to each other such that the discharge spaces are arranged at an equal distance, and other sides of the first electrode groups and the second electrode groups are set to a second distance equal to the first distance including widths of the second electrodes.

The second distance includes a width of the second electrode of the first electrode group and a width of the first electrode thereof, and a width of the first electrode of the second electrode group and a width of the second electrode thereof.

The plasma display panel further includes a first black matrix provided between said three electrodes; and a second black matrix formed at the same width as the first black matrix in such a manner to overlap with the first electrodes.

Otherwise, the plasma display panel further includes a first black matrix provided between said three electrodes; and a second black matrix formed at the same width as the first black matrix between first electrodes.

The first to third electrodes are set to have the same width.

At least one of the first to third electrodes is set to have a different width.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Figure 1:
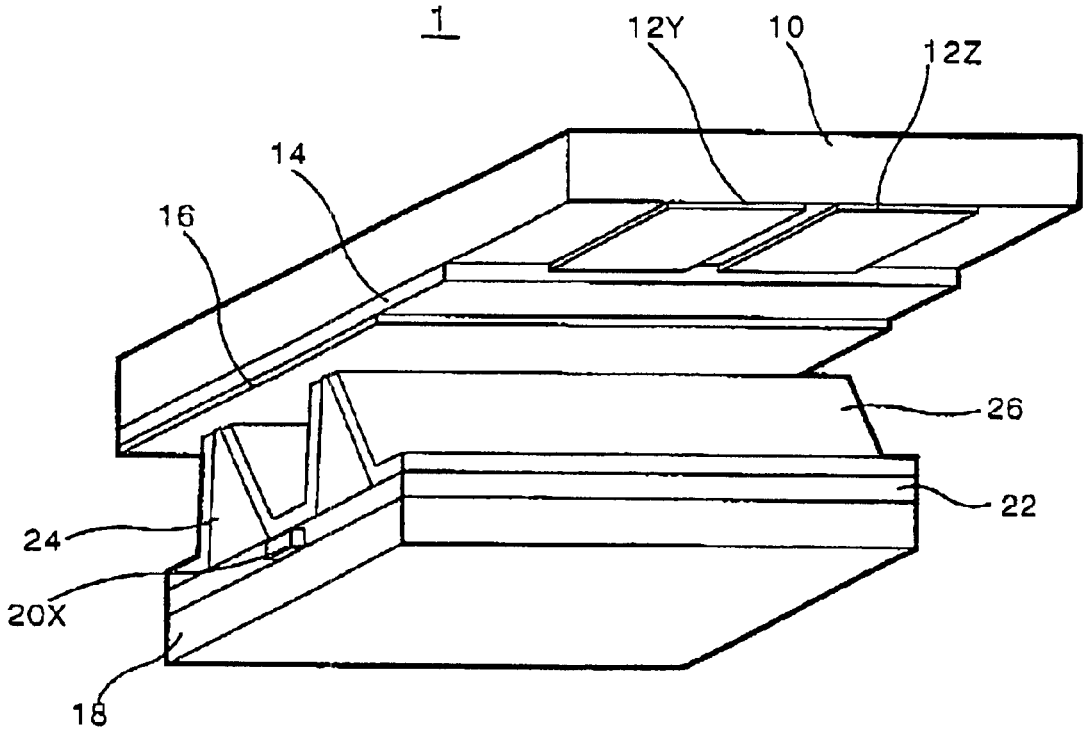
FIG. 1 CONVENTIONAL ART
FIG. 1 is a perspective view showing a discharge cell structure of a conventional three-electrode AC surface-discharge plasma display panel.
Figure 2:
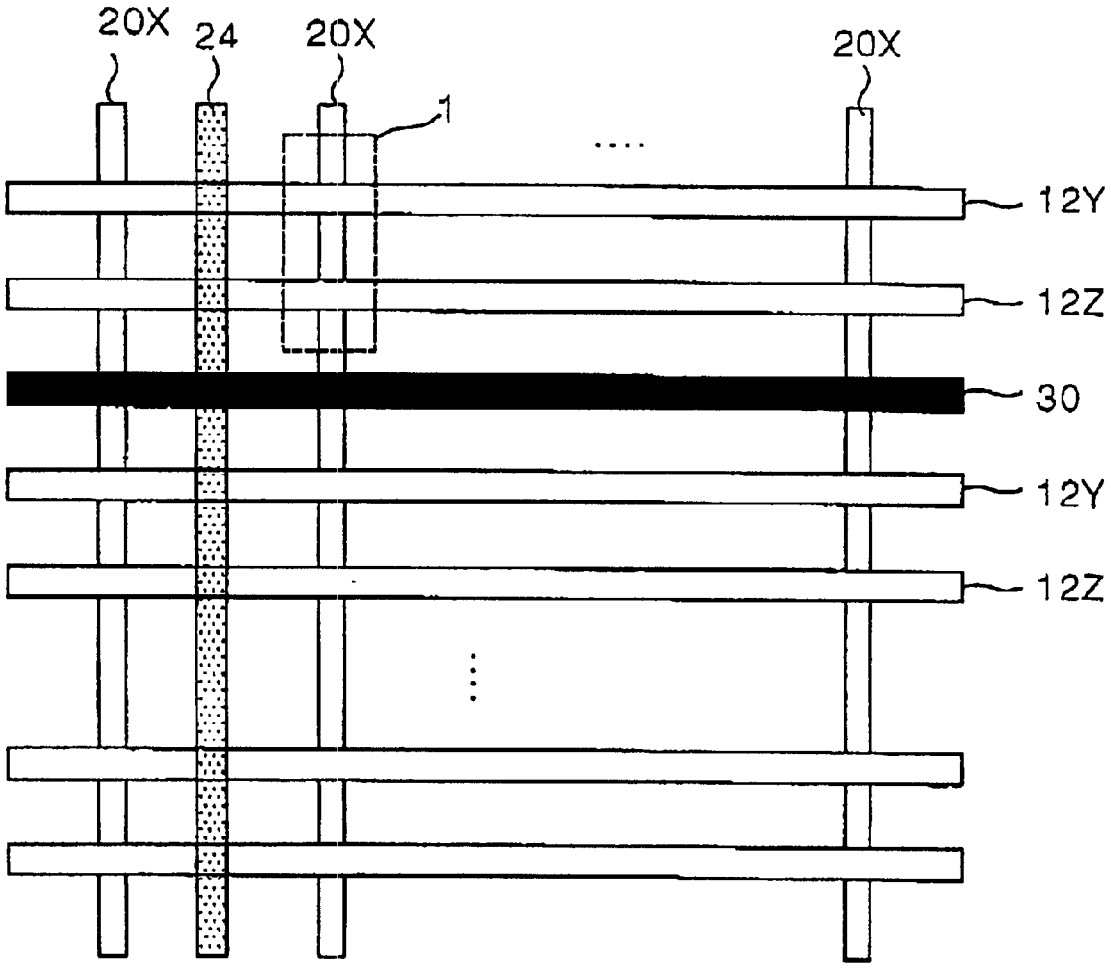
FIG.2 CONVENTIONAL ART
FIG. 2 illustrates a discharge cell arrangement of the AC surface discharge plasma display panel shown in FIG. 1.
Figure 3:
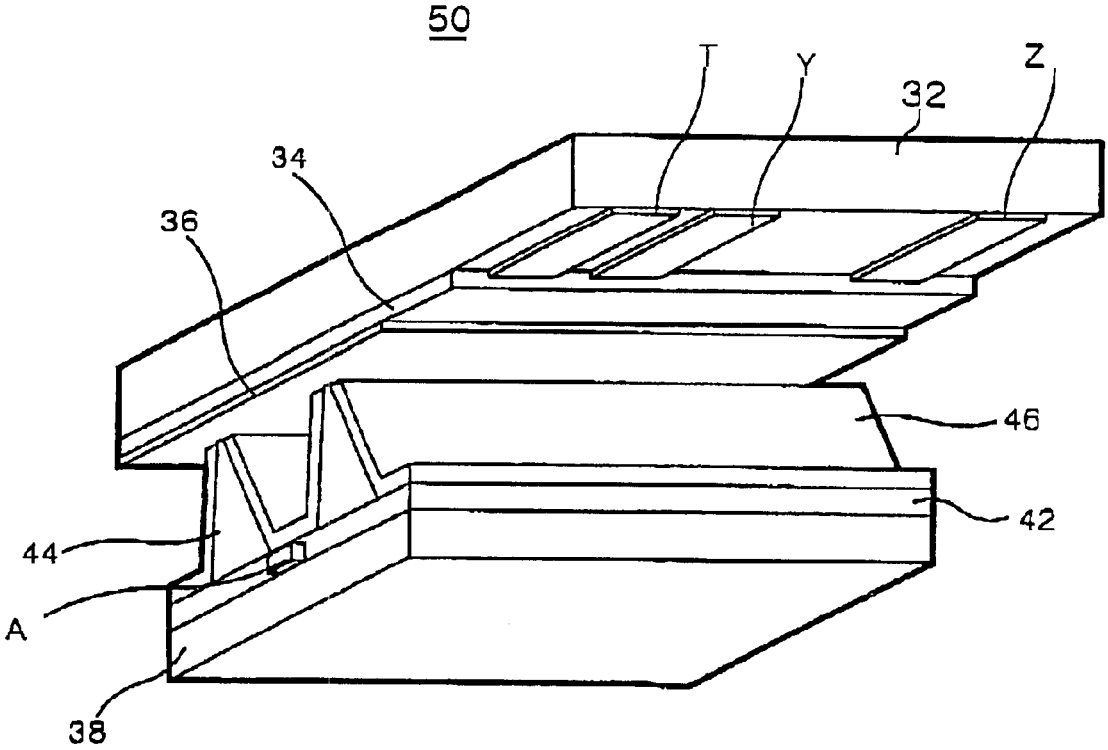
FIG. 3 CONVENTIONAL ART
FIG. 3 is a perspective view showing a discharge cell structure of a conventional four-electrode AC surface-discharge plasma display panel.
Figure 4:
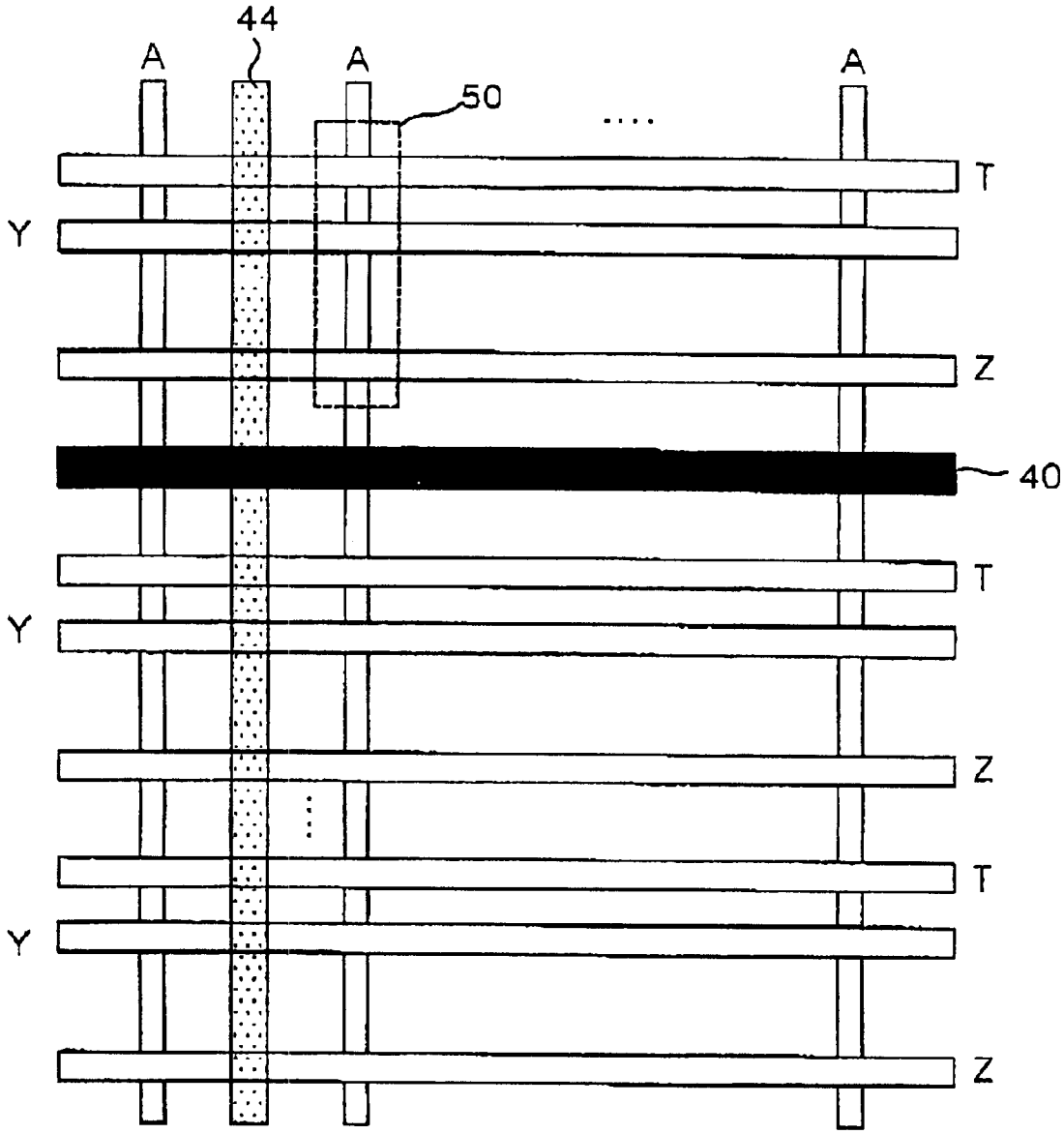
FIG. 4 CONVENTIONAL ART
FIG. 4 illustrates a discharge cell arrangement of the four-electrode AC surface-discharge plasma display panel shown in FIG. 3.
Figure 5:
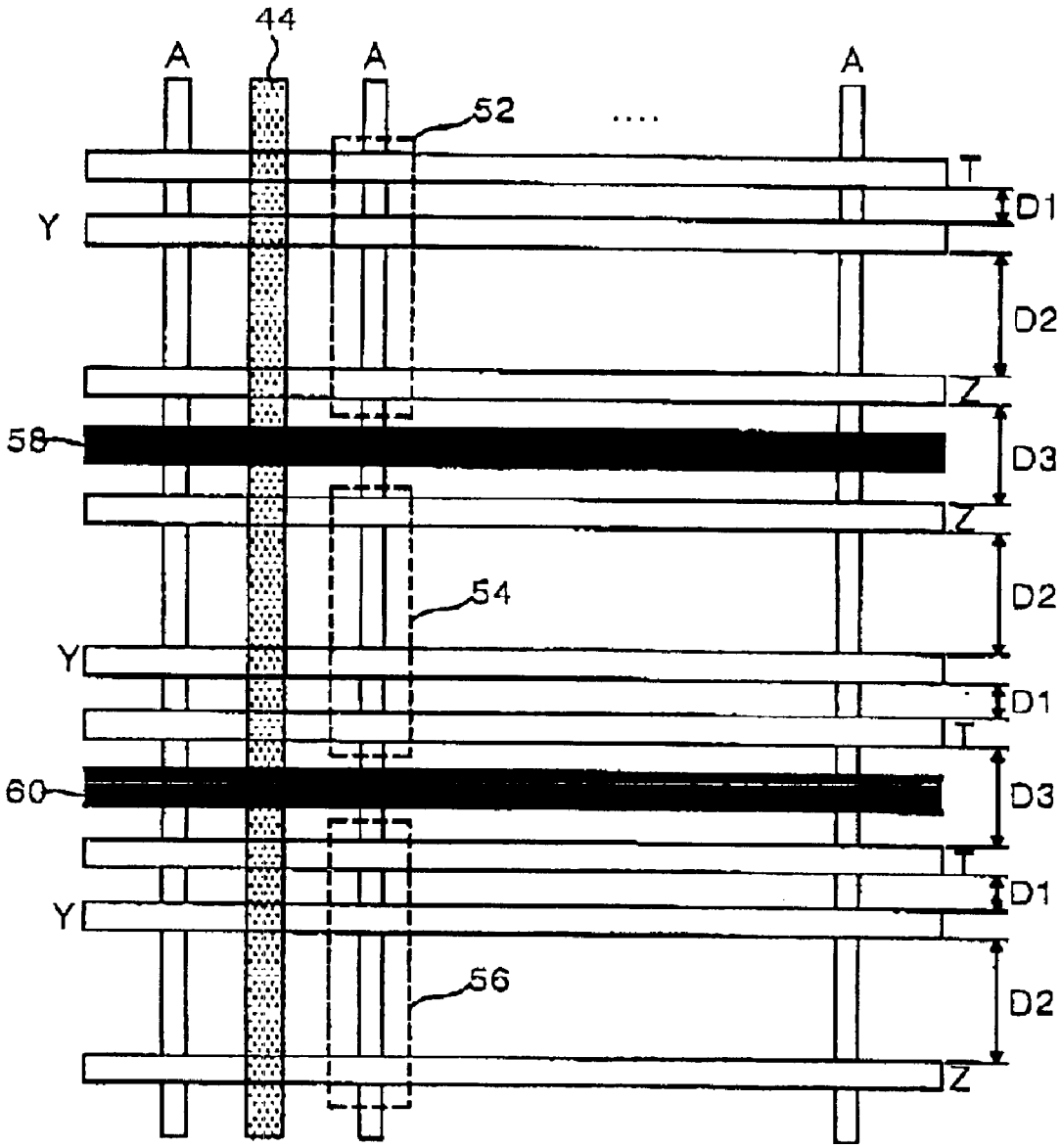
FIG. 5 CONVENTIONAL ART
FIG. 5 illustrates a conventional four-electrode AC surface-discharge plasma display panel according to another embodiment.
Figure 6:
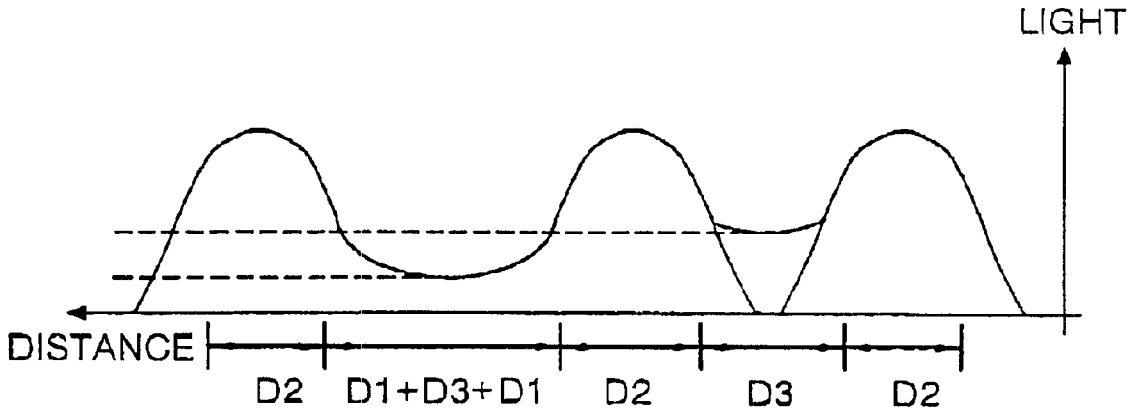
FIG.6 CONVENTIONAL ART
FIG. 6 is a graph representing a brightness according to a discharge cell position of the four-electrode AC surface-discharge plasma display panel shown in FIG. 5
Figure 7:
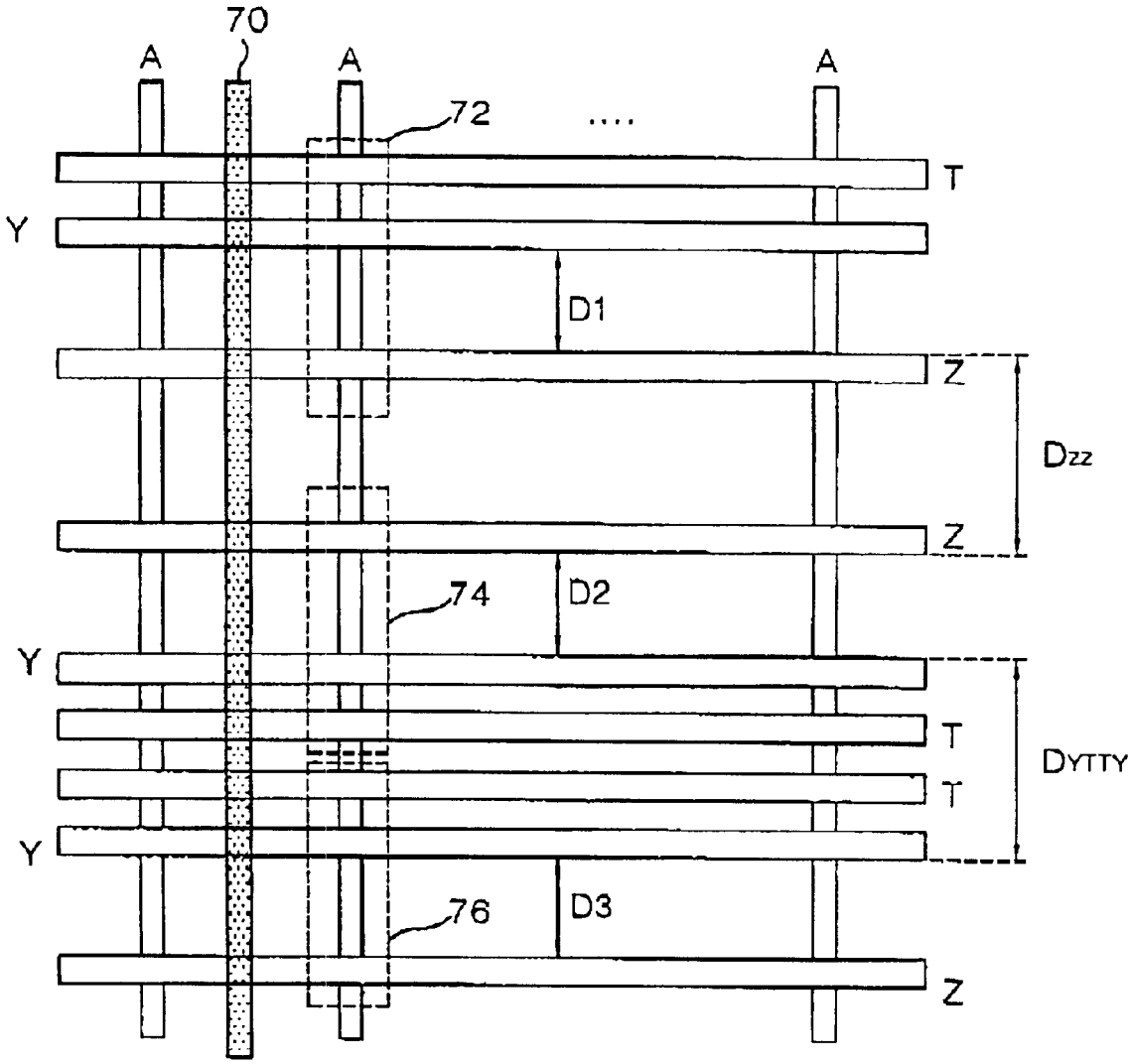
FIG. 7 illustrates a four-electrode AC surface-discharge plasma display panel according to an embodiment of the present invention.

Referring to FIG. 7, there is shown a four-electrode, alternating current (AC) surface-discharge PDP according to an embodiment of the present invention.

The four-electrode AC surface-discharge PDP includes a first electrode T, a second electrode Y and a third electrode Z provided, in parallel to each other, on an upper substrate (not shown), and an address electrode A provided on a lower substrate (not shown). A barrier rib 70 is provided between the upper substrate and the lower substrate. The barrier rib 70 is formed in parallel to the address electrode A to prevent an ultraviolet ray and a visible light generated by a discharge from being leaked into adjacent discharge cells.

The discharge cells 72, 74 and 76 are positioned at an intersection between the first to third electrodes T, Y and Z and the address electrode A. The first electrodes T and third electrodes Z included in the discharge cells 72, 74 and 76 are arranged such that they are adjacent to the same electrodes T and Z. In other words, the third electrode Z is provided at the upper side of the second discharge cell 74. The lower side of the first discharge cell 72 being adjacent to the third electrode Z is provided with the third electrode Z. In other words, the same electrode Z is provided at a boundary portion between the first discharge cell 72 and the second discharge cell 74. Further, the lower side of the second discharge cell 74 is provided with the first electrode T. The upper side of the third discharge cell 76 being adjacent to the first electrode T is provided with the first electrode T. In other words, the same electrode T is provided at a boundary portion between the second discharge cell 74 and the third discharge cell 76.

In the PDP according to the embodiment of the present invention, a distance $D_{ZZ}$ between the third electrodes Z being adjacent to each other is set to be equal to a distance $D_{YTTY}$ between the second electrodes Y, the first electrodes T and the first electrode T and the second electrode Y. Accordingly, the discharge spaces D1, D2 and D3 included in each discharge cell 72, 74 and 76 are arranged at an equal distance.

More specifically, the first discharge space D1 and the second discharge space D2 is spaced at the distance $D_{ZZ}$ between the third electrodes Z being adjacent to each other. Further, the second discharge space D2 and the third discharge space D3 are spaced at the distance $D_{YTTY}$ between the second electrodes Y, the first electrodes T and the first electrode T and the second electrode Y. Herein, all the discharge spaces D1, D2 and D3 are arranged at an equal distance because these distances $D_{ZZ}$ and $D_{YTTY}$ are set at an equal distance. The distances $D_{ZZ}$ and $D_{YTTY}$ include a width of each electrode T, Y and Z.

Figure 8:
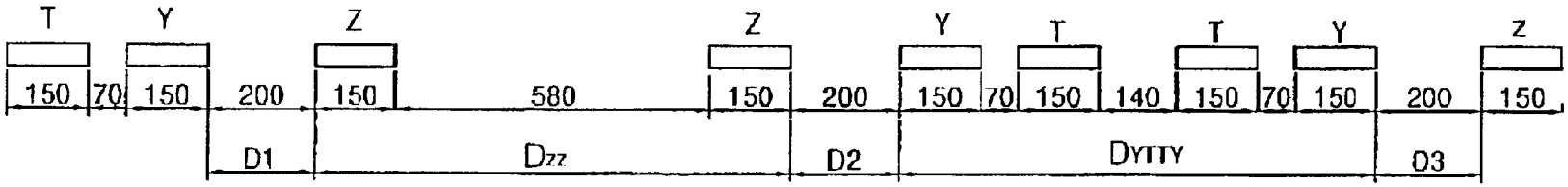
FIG. 8 to FIG. 10 depict electrodes arranged in accordance with the electrode arrangement shown in FIG. 7.

FIG. 8 shows electrodes arranged in accordance with an electrode arrangement shown in FIG. 7. In FIG. 8, all the electrodes T, Y and Z have the same width.

Referring to FIG. 8, widths of the first electrode T, the second electrode Y and the third electrode Z are set to 150 $\mu$m. Widths of the discharge spaces D1, D2 and D3, that is, distances between the second electrodes Y and the third electrodes Z are set to 200 $\mu$m. A distance between the first electrode T and the second electrode Y is set to 70 $\mu$m. A distance between the third electrodes Z is set to 580 $\mu$m while a distance between the first electrodes T is set to 140 $\mu$m.

Herein, the distance $D_{ZZ}$ is set to 880 $\mu$m, which is a value obtained by adding the width of two third electrodes Z (i.e., 150 $\mu$m+150 $\mu$m) to the distance between two third electrodes Z (i.e., 580 $\mu$m). The distance $D_{YTTY}$ is set to 880 $\mu$m, which is a value obtained by summing the width of four electrodes Y, T, T and Y (i.e., 150 $\mu$m+150 $\mu$m+150 $\mu$m+150 $\mu$m), the distances between the second electrodes Y and the first electrodes (i.e., 70 $\mu$m+70 $\mu$m) and the distance between the first electrodes T (i.e., 140 μm). In other words, the distances $D_{ZZ}$ and $D_{YTTY}$ are set equally as shown in FIG. 8, so that the discharge spaces D1, D2 and D3 can be arranged at an equal distance.

Figure 9:
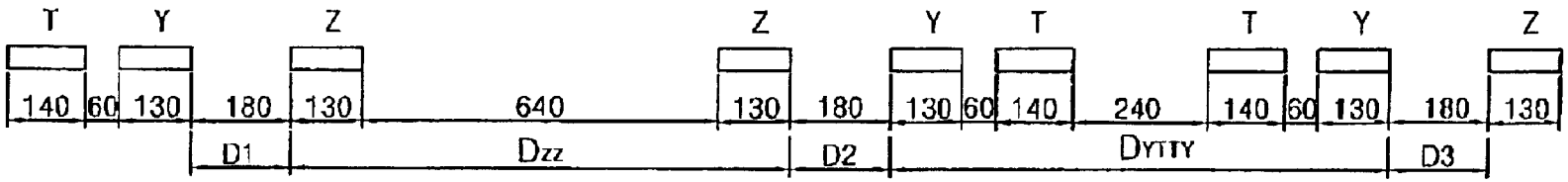

FIG. 9 depicts electrodes arranged in accordance with other embodiment.

Referring to FIG. 9, widths of the second electrode Y and the third electrode Z are equally set to 130 μm while a width of the first electrode T is set to be larger than widths of the second and third electrodes Y and Z. Herein, a width of the first electrode T is set to 140 μm. Widths of the discharge spaces D1, D2 and D3, that is, distances between the second electrodes Y and the third electrodes Z are set to 180 μm. A distance between the first electrode T and the second electrode Y is set to 60 μm. A distance between the third electrodes Z is set to 640 μm while a distance between the first electrodes T is set to 240 μm.

Herein, the distance $D_{ZZ}$ is set to 900 μm, which is a value obtained by adding the width of two third electrodes Z (i.e., 130 μm+130 μm) to the distance between two third electrodes Z (i.e., 640 μm). The distance $D_{YTTY}$ is set to 900 μm, which is a value obtained by summing the widths of four electrodes Y, T, T and Y (i.e., 130 μm+140 μm+140 μm+130 μm), the distances between the second electrodes Y and the first electrodes (i.e., 60 μm+60 μm) and the distance between the first electrodes T (i.e., 240 μm). In other words, the distances $D_{ZZ}$ and $D_{YTTY}$ are set equally as shown in FIG. 9, so that the discharge spaces D1, D2 and D3 can be arranged at an equal distance.

Figure 10:
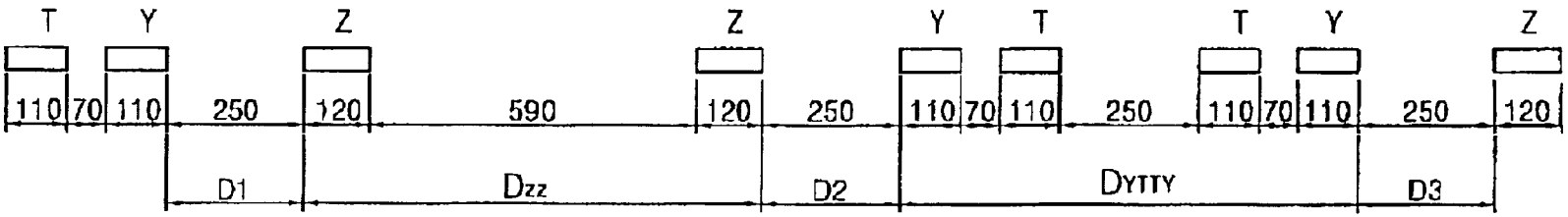

FIG. 10 depicts electrodes arranged in accordance with another embodiment.

Referring to FIG. 10, widths of the first electrode T and the second electrode Y are equally set to 110 μm while a width of the third electrode Z is set to be larger than widths of the first and second electrodes T and Y. Herein, a width of the third electrode Z is set to 120 μm. Widths of the discharge spaces D1, D2 and D3, that is, distances between the second electrodes Y and the third electrodes Z are set to 250 μm. A distance between the first electrode T and the second electrode Y is set to 70 μm. A distance between the third electrodes Z is set to 590 μm while a distance between the first electrodes T is set to 250 μm.

Herein, the distance $D_{ZZ}$ is set to 830 μm, which is a value obtained by adding the width of two third electrodes Z (i.e., 120 μm+120 μm) to the distance between two third electrodes Z (i.e., 590 μm). The distance $D_{YTTY}$ is set to 830 μm, which is a value obtained by summing the widths of four electrodes Y, T, T and Y (i.e., 110 μm+110 μm+110 μm+110 μm), the distances between the second electrodes Y and the first electrodes (i.e., 70 μm+70 μm) and the distance between the first electrodes T (i.e., 250 μm). In other words, the distances $D_{ZZ}$ and $D_{YTTY}$ are set equally as shown in FIG. 10, so that the discharge spaces D1, D2 and D3 can be arranged at an equal distance.

Accordingly, in the present invention, the distances $D_{ZZ}$ and $D_{YTTY}$ are set equally irrespectively of the widths of the electrodes T, Y and Z and the distances between the electrodes T, Y and Z, so that the discharge spaces D1, D2 and D3 can be arranged at an equal distance.

Figure 11:
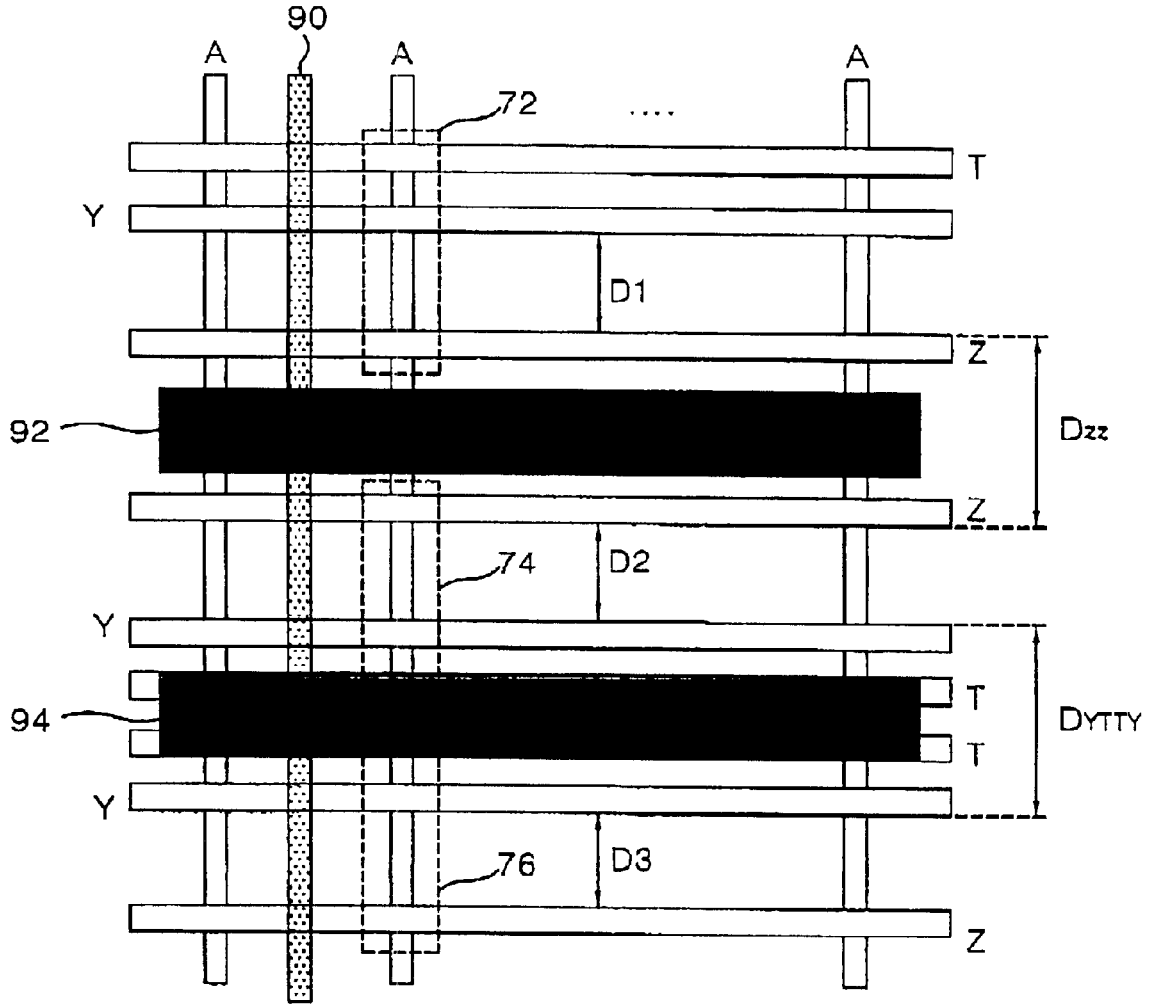
FIG. 11 illustrates black matrices provided at the four-electrode AC surface-discharge plasma display panel shown in FIG. 7.

FIG. 11 shows the four-electrode AC surface-discharge PDP shown in FIG. 7 that is provided with a black matrix.

Referring to FIG. 11, the black matrices 92 and 94 is formed in parallel to the first to third electrodes T, Y and Z at a boundary portion of the discharge cells 72, 74 and 76. The black matrix 92 positioned between the first discharge cell 72 and the second discharge cell 74 is provided between the third electrodes Z. The black matrix 94 positioned between the second discharge cell 74 and the third discharge cell 76 is formed in such a manner to overlap with the first electrodes T positioned at the lower and upper side of the second discharge cell 74 and the third discharge cell 76.

Since the third electrodes Z provided at the lower side of the first discharge cell 72 and at the upper side of the second discharge cell 74 are formed at a wide distance $D_{ZZ}$, the black matrix 92 is provided between the third electrodes Z. Otherwise, since the first electrodes T provided at the lower side of the second discharge cell 74 and at the upper side of the third discharge cell 76 are formed at a narrow distance, the black matrix 94 is formed in such a manner to overlap with the first electrodes T. Alternatively, the black matrices 92 and 94 may be formed at widths less than a desired value between the first electrodes T provided at the lower side of the second discharge cell 74 and at the upper side of the third discharge cell 76.

As described above, according to the present invention, a discharge space causing a sustain discharge is arranged at an equal distance at its upper and lower portions. Accordingly, the PDP according to the present invention can display a uniform picture.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a plurality of first electrode groups, each of which includes first and second electrodes formed adjacently to each other and third electrodes spaced at a large distance from the second electrodes; and a plurality of second electrode groups being adjacent to the first electrode groups and having the first electrodes, the second electrodes and the third electrodes arranged in a mirror type, wherein one sides of the first electrode groups and the second electrode groups are set to a first distance including widths of the third electrodes being adjacent to each other, and other sides of the first electrode groups and the second electrode groups are set to a second distance equal to the first distance including widths of the second electrodes.

2. The plasma display panel as claimed in claim 1, wherein the second distance includes a width of the second electrode of the first electrode group and a width of the first electrode thereof, and a width of the first electrode of the second electrode group and a width of the second electrode thereof.

3. The plasma display panel as claimed in claim 1, wherein a sustain discharge contributing to a brightness occurs at a discharge space between the second electrode and the third electrode.

4. The plasma display panel as claimed in claim 3, wherein discharge spaces included in the first and second electrode group are arranged at an equal distance.

5. The plasma display panel as claimed in claim 1, further comprising:

a first black matrix provided between said three electrodes; and a second black matrix formed at the same width as the first black matrix in such a manner to overlap with the first electrodes.

6. The plasma display panel as claimed in claim 1, further comprising:

a first black matrix provided between said three electrodes; and a second black matrix formed at the same width as the first black matrix between first electrodes.

7. The plasma display panel as claimed in claim 1, wherein the first to third electrodes are set to have the same width.

8. The plasma display panel as claimed in claim 1, wherein at least one of the first to third electrodes is set to have a different width.

9. A plasma display panel, comprising:

a plurality of first electrode groups, each of which includes first and second electrodes formed adjacently to each other and third electrodes spaced at a large distance from the second electrodes; and a plurality of second electrode groups being adjacent to the first electrode groups and having the first electrodes, the second electrodes and the third electrodes arranged in a mirror type, wherein a sustain discharge contributing a brightness is generated at a discharge space between the second electrode and the third electrode, and said discharge spaces included in the first electrode groups and the second electrode groups are spaced from each other by an equal distance.

10. The plasma display panel as claimed in claim 9, wherein one sides of the first electrode groups and the second electrode groups are set to a first distance including widths of the third electrodes being adjacent to each other such that the discharge spaces are arranged at an equal distance, and other sides of the first electrode groups and the second electrode groups are set to a second distance equal to the first distance including widths of the second electrodes.

11. The plasma display panel as claimed in claim 10, wherein the second distance includes a width of the second electrode of the first electrode group and a width of the first electrode thereof, and a width of the first electrode of the second electrode group and a width of the second electrode thereof.

12. The plasma display panel as claimed in claim 10, further comprising:

a first black matrix formed provided between said three electrodes; and a second black matrix formed at the same width as the first black matrix in such a manner to overlap with the first electrodes.

13. The plasma display panel as claimed in claim 10, further comprising:

a first black matrix provided between said three electrodes; and a second black matrix formed at the same width as the first black matrix between first electrodes.

14. The plasma display panel as claimed in claim 10, wherein the first to third electrodes are set to have the same width.

15. The plasma display panel as claimed in claim 10, wherein at least one of the first to third electrodes is set to have a different width.

* * * * *